US006145161A

United States Patent [19]

Jou

[11] Patent Number: 6,145,161

[45] Date of Patent: Nov. 14, 2000

[54] MULTIFUNCTIONAL DUST-ABATING GUN

[76] Inventor: Wuu-Cheau Jou, No. 95, Cheng Kung 2nd Rd., Tali City, Taichung Hsien, Taiwan

[21] Appl. No.: 09/264,680

[22] Filed: Mar. 9, 1999

[51] Int. Cl.[7] ..... A47L 5/14

[52] U.S. Cl. ..... 15/331; 15/405; 239/391

[58] Field of Search ..... 15/331, 405; 239/390, 239/391, 525, 526

[56] References Cited

U.S. PATENT DOCUMENTS

| | | | |
|---|---|---|---|
| 2,069,667 | 2/1937 | Clawson | 239/391 X |
| 2,320,964 | 6/1943 | Yates | 15/405 X |
| 2,604,361 | 7/1952 | Yates | 15/405 X |
| 3,827,635 | 8/1974 | Krakowski et al. | 239/391 |
| 3,938,218 | 2/1976 | DeAmicis | 15/405 X |
| 4,903,897 | 2/1990 | Hayes | 239/525 X |
| 5,333,790 | 8/1994 | Christopher | 239/391 |
| 5,887,796 | 3/1999 | Dimmer | 239/526 X |
| 5,944,911 | 8/1999 | Winters et al. | 15/405 X |

*Primary Examiner*—Chris K. Moore
*Attorney, Agent, or Firm*—Rosenberg, Klein & Lee

[57] ABSTRACT

A multifunctional dust-abating gun includes a main coupler for coupling with a dust-abating fitting, an inflation needle for inflating balls, or an inflation fitting for inflating rubber life rings, thereby performing the functions of dust abatement or inflation of tires or balls. The main coupler may be coupled with a quick coupler which, in turn, is coupled with a sprayer fitting, dust-suction fitting, or dust-abating fitting, thereby performing the functions of water spraying, dust suction, or dust abatement. The quick coupler includes a U-shaped groove to allow easy and quick engagement/disengagement with/from a dust-abating barrel, a sprayer fitting, or a dust-section fitting. Alternatively, the main coupler may be coupled with an inflation device that includes a freely rotatable main body to prevent a pressure gauge on the main body from being damaged.

1 Claim, 8 Drawing Sheets

MULTIFUNCTIONAL DUST-ABATING GUN

BACKGROUND OF THE INVENTION

1. Field of the Invention

The present invention relates to a multifunctional dust-abating gun that includes a main coupler for coupling with a dust-abating fitting, an inflation needle for inflating balls, or an inflation fitting for inflating rubber life rings, thereby performing the functions of dust abatement or inflation of tires or balls. The main coupler may be coupled with a quick coupler which, in turn, is coupled with a sprayer fitting, dust-suction fitting, or dust-abating fitting, thereby performing the functions of water spraying, dust suction, or dust abatement. Alternatively, the main coupler may be coupled with an inflation means for inflating tires or releasing pressure of the tires. The inflation means may rotate freely.

2. Description of the Related Art

FIG. 1 of the drawings illustrates a typical dust-abating gun 10 with a fixed barrel 11 that is a frequently used tool in industry or family. Yet, the fixed barrel 11 cannot be neither rotated nor replaced. Thus, the dust-abating gun 10 can only be used to abate dust. FIG. 2 illustrates a typical tire inflation gun that is also frequently used. A hose 21 is threadedly engaged with to the inflation gun 20 and includes an inflation valve coupler 22. A pressure gauge 23 is attached to the inflation gun 20 to detect the air pressure fed back from the tire. The pressure gauge 23 and the hose 22 are both secured to the inflation gun 20 by threading engagement and thus cannot be rotated during use. As a result, inconvenience is occurred when in a limited space, as the operator must keep the pressure gauge 23 in a place that allows easy reading of air pressure. In addition, the pressure gauge 23 is fragile and might be damaged or broken and thus adversely affects the precision, as the pressure gauge 23 tends to be impinged by objects when in use.

Users have to buy both of the dust-abating gun 10 and the tire inflation gun 20, as they are separate and have only one function. This results in an additional expenditure. In addition to the frequently used dust-abating gun 10 and the tire inflation gun 20, inflation needles for inflating all kinds of balls and inflation fittings for inflating rubber or plastic life ring are also frequently used in daily life. It is a long and unfulfilled need to combine the above-mentioned articles to lower the cost and to provide convenient use to the users.

SUMMARY OF THE INVENTION

A dust-abating gun in accordance with the present invention comprises a main coupler for engaging with one of an inflation means and a quick coupler. The main coupler includes a hexagonal head with an inner screw hole for coupling with all kinds of tools and a hollow shank extended from the hexagonal head. The shank includes an outer threading so as to be attached to the dust-abating gun by threading engagement. A through-hole extends through the hexagonal head and the shank through which compressed air from the dust-abating gun is outputted.

The quick coupler includes a first main body and a fitting with an outer threading for engaging with the inner screw hole of the main coupler. The fitting includes a nut integrally formed around a mediate portion thereof to separate the outer threading into two portions. The first main body includes a first end, a second end, and a U-shaped groove defined in a mediate portion thereof and having a side opening. A screw hole is defined in the first end of the main body and communicated with the U-shaped groove. A U-shaped flange is formed in the second end of the first main body to thereby define a U-shaped opening that also communicates with the U-shaped groove. The U-shaped groove receives a coupling member of a tool. The coupling member of the tool includes a first annular groove in an outer periphery thereof. The coupling member further includes an end with an end face having an annular groove for receiving a rubber seal ring to bear against an end face of the fitting of the quick coupler, thereby providing quick positioning and preventing leakage.

The inflation means includes a second main body having a longitudinal stepped through-hole for pivotally receiving a pivotal plug, thereby allowing free rotational movement of the second main body. The pivotal plug includes a threaded shank. An inflation fitting includes a first end threadedly engaged with the threaded shank of the pivotal plug and a second end threadedly engaged with the screw hole of the main coupler and thus attached to the dust-abating gun. A hose is threadedly engaged in an end of the longitudinal stepped through-hole. A pressure gauge is attached to the main body to indicate the air pressure.

A relief valve is attached to the second main body of the inflation means. The relief valve includes a base with a stepped through-hole for slidably receiving a relief plug. A spring is mounted around the relief plug and includes an end attached to a peripheral wall that defines the stepped through-hole of the base. The relief plug includes a first end extended beyond the stepped through-hole of the base and a second end. An O-ring is mounted to the second end thereof for sealing the stepped through-hole of the base under the action of the spring on the relief plug.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
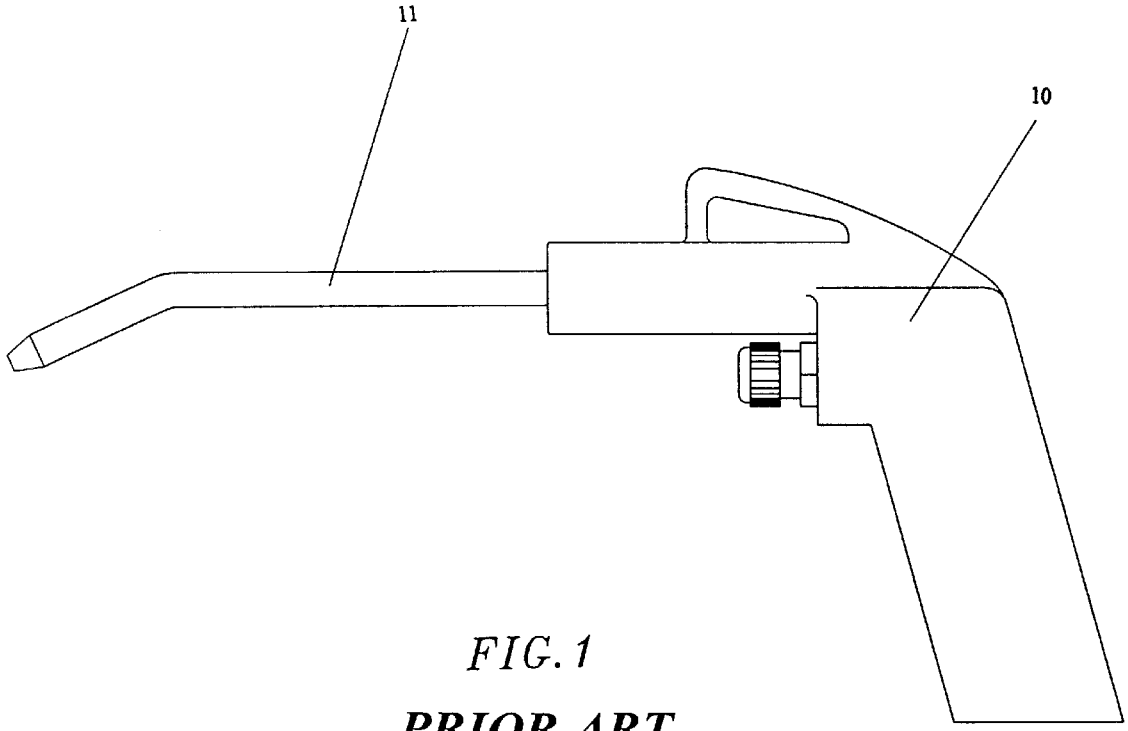
FIG. 1 PRIOR ART
FIG. 1 is a side view of a conventional dust-abating gun.
Figure 2:
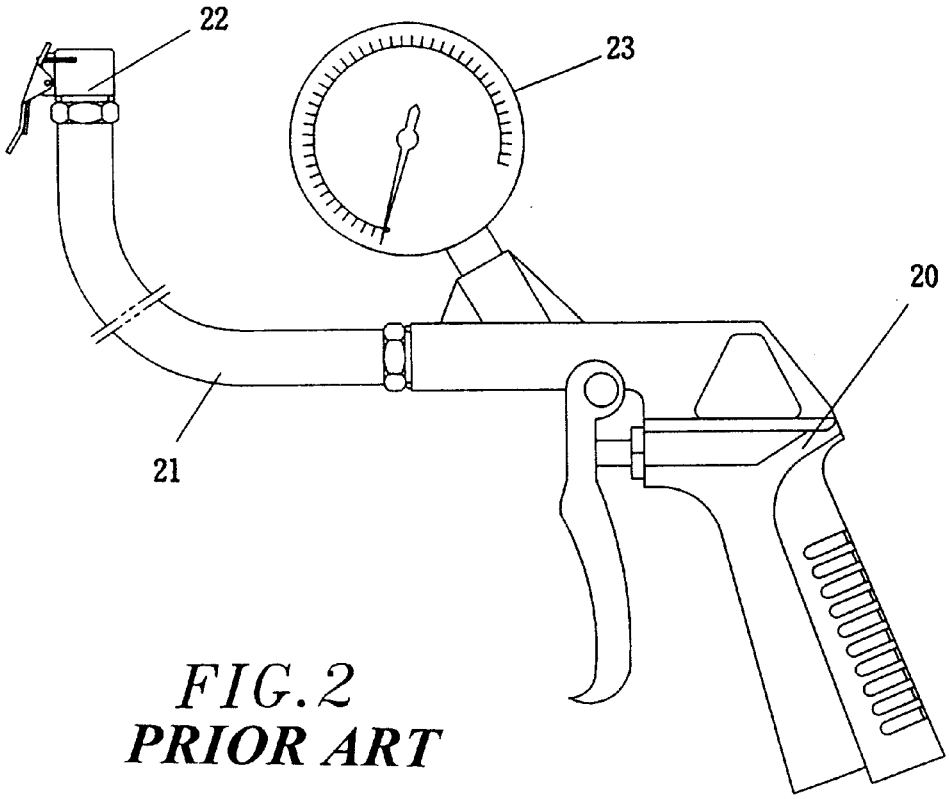
FIG. 2 PRIOR ART
FIG. 2 is a side view of a conventional tire inflation gun.
Figure 3:
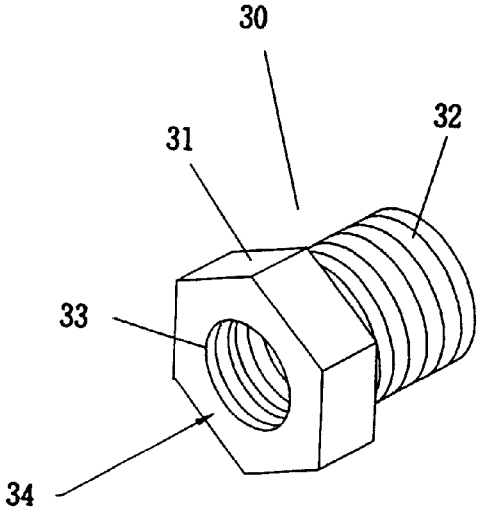
FIG. 3 is a perspective view of a main coupler in accordance with the present invention.
Figure 4:
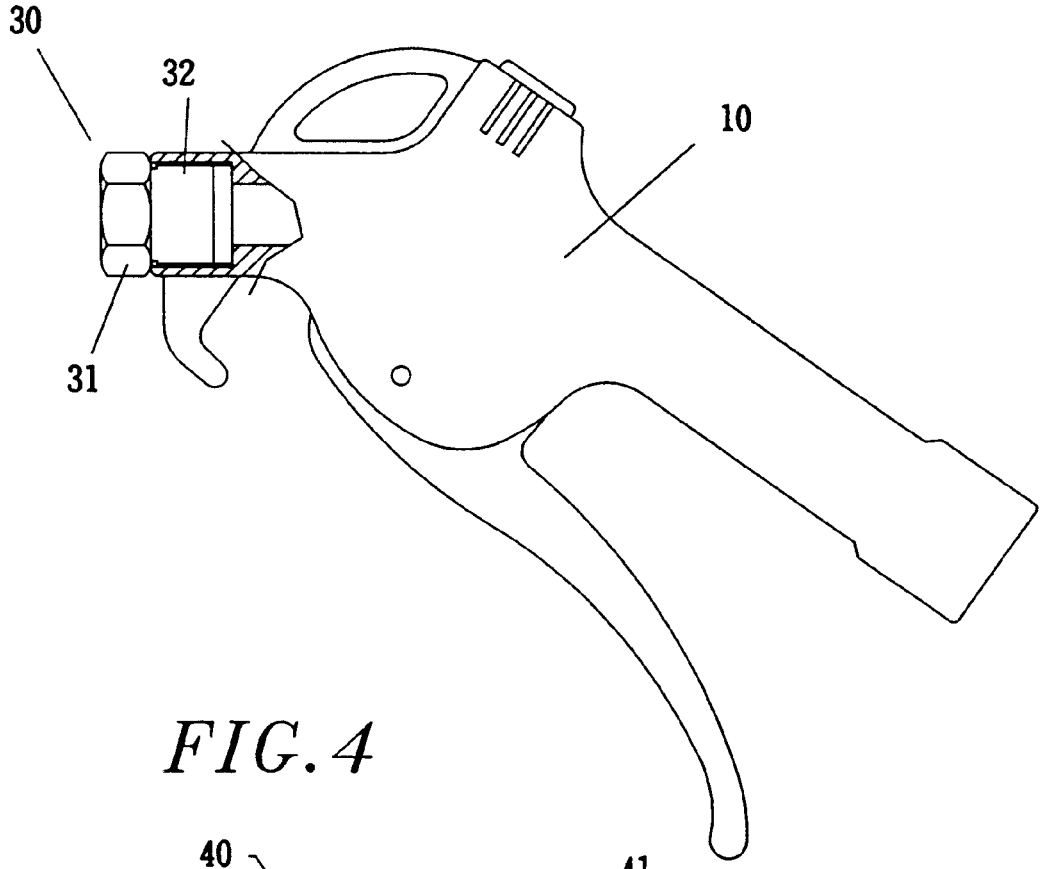
FIG. 4 is a side view of a dust-abating gun with the main coupler in accordance with the present invention.

Referring to FIG. 3, the present invention provides a main coupler 30 that includes a hexagonal head 31 with an inner screw hole 33 for coupling with all kinds of tools and a hollow shank 32 extended from a side of the hexagonal head 31. The shank 32 includes an outer threading so as to be attached to a dust-abating gun 10 (see FIG. 4) by threading engagement. A through-hole 34 extends through the main coupler 30 (including the hexagonal head 31 and the shank 32) through which compressed air from the dust-abating gun 10 is outputted. The main coupler 30 may be coupled with a quick coupler 40 or an inflation means 60.

Figure 5:
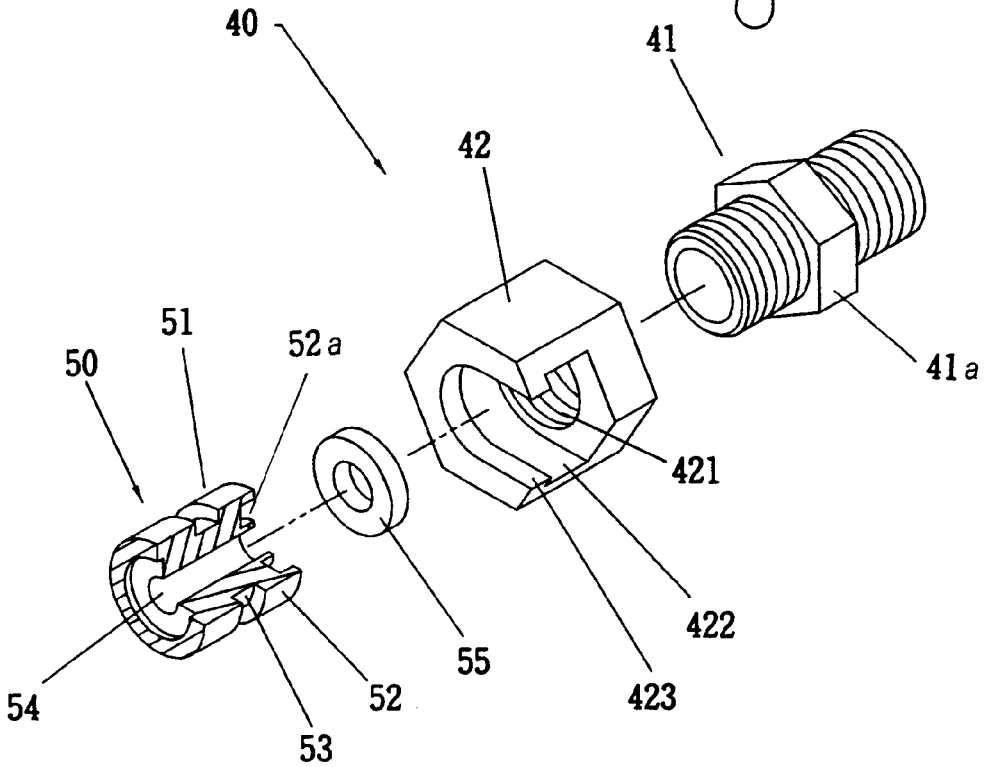
FIG. 5 is an exploded perspective view of a quick coupler in accordance with the present invention.

Referring to FIG. 5, the quick coupler 40 includes a main body 42 and a fitting 41 with an outer threading. The fitting 41 includes a nut 41*a* integrally formed around a mediate portion thereof to separate the outer threading into two portions. The main body 42 includes a substantially U-shaped groove 422 defined in a mediate portion thereof and having a side opening. A screw hole 421 is defined in an end of the main body 42 and communicates with the groove 422. A substantially U-shaped flange 423 is formed in the other end of the main body 42 to thereby define a substantially U-shaped opening that also communicates with the groove 422. A coupling member 51 of a tool 50 (e.g., a sprayer fitting 56, see FIG. 6) may be inserted into the groove 422 via the U-shaped opening. The coupling member 51 of the tool 50 includes an annular groove 53 in an outer periphery thereof. An annular groove 52*a* is defined in an end face of an end 52 of the coupling member 51 for receiving a rubber seal ring 55 to bear against an end face of the fitting 41, thereby providing quick positioning and preventing leakage. The coupling member 41 further includes a through-hole 54 through which compressed air is passable.

Figure 10:
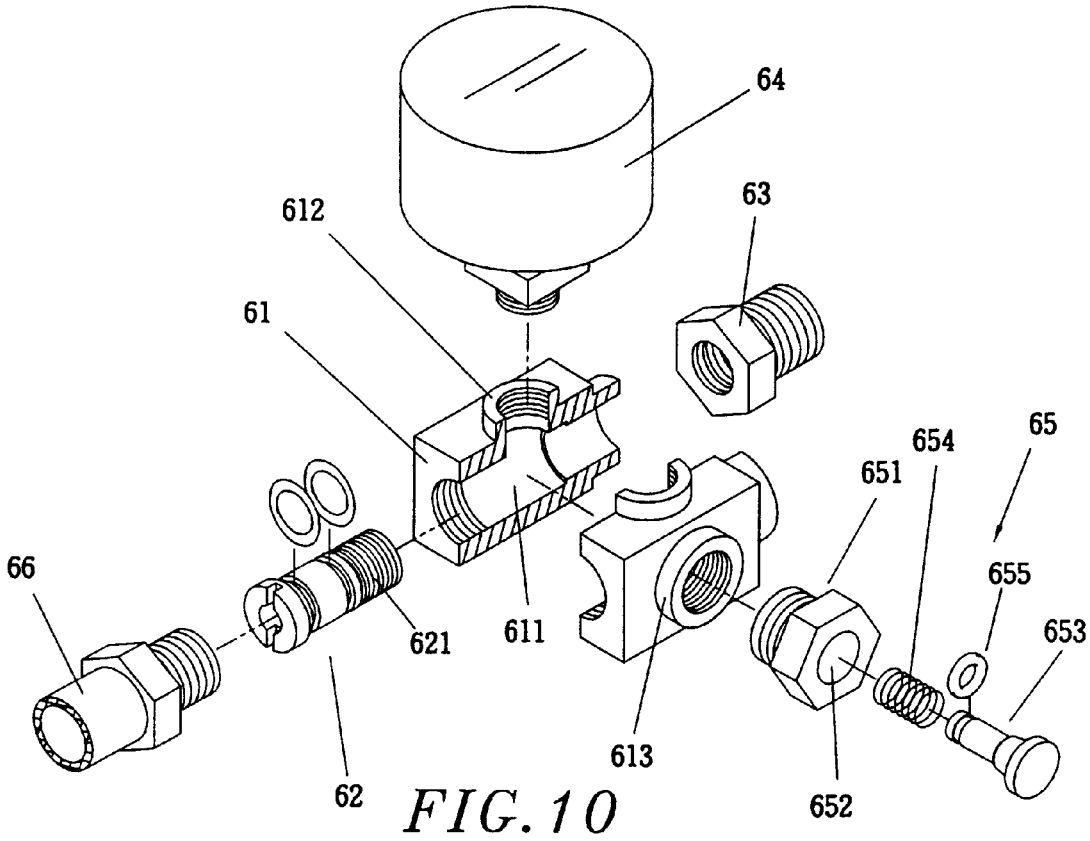
FIG. 10 is an exploded perspective view of an inflation means in accordance with the present invention.
Figure 11:
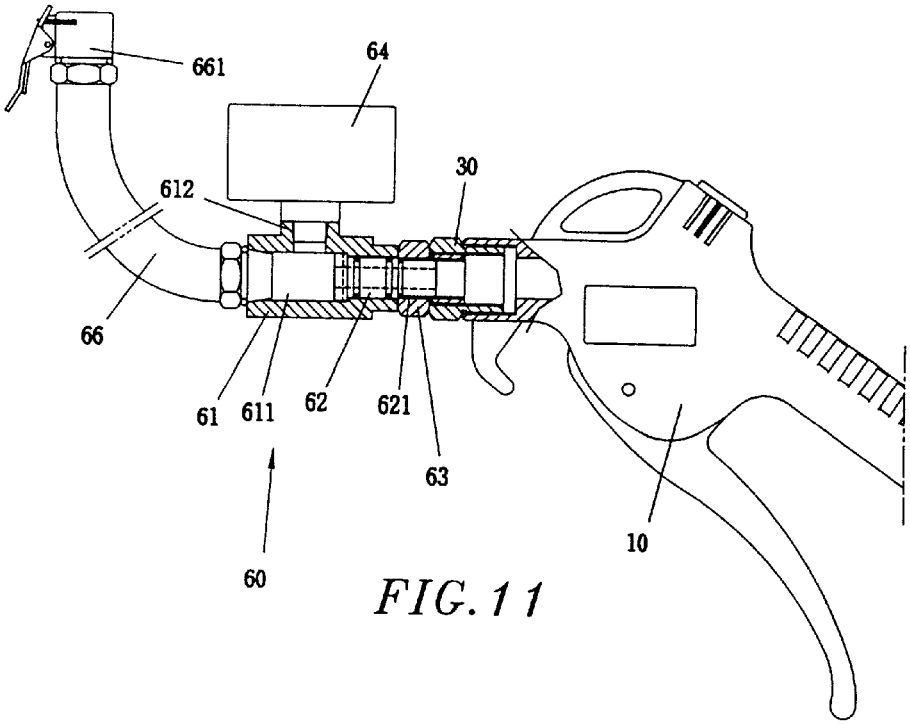
FIG. 11 is a partial side view, partially sectioned, of an inflation gun with the inflation means in accordance with the present invention.
Figure 12:
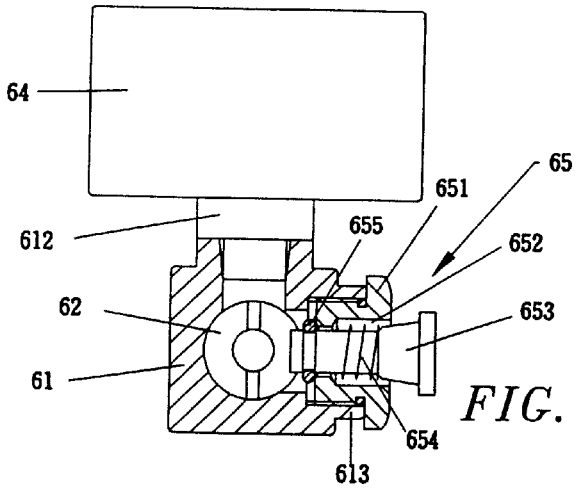
FIG. 12 is a side view, partially sectioned, illustrating a relief valve of the inflation means.

Referring to FIGS. 10 and 11, the inflation means 60 includes a main body 61 having a longitudinal stepped through-hole 611 for pivotally receiving a pivotal plug 62, thereby allowing free rotational movement of the main body 61. The pivotal plug 62 includes a threaded shank 621 for threadedly engaging with an inflation fitting 63 that is threadedly engaged with the main coupler 30 and thus attached to the dust-abating gun 10. A hose 66 is threadedly engaged in an end of the stepped through-hole 611. In addition, a pressure gauge 64 is threadedly engaged with a boss 612 formed on top of the main body 61 to indicate air pressure. A relief valve 65 is attached to a boss 613 formed on a side of the main body 61. Referring to FIGS. 10 and 12, the relief valve 65 includes a base 651 with a stepped through-hole 652 for slidably receiving a relief plug 653. A spring 654 is mounted around the relief plug 653 and includes an end attached to a peripheral wall that defines the stepped through-hole 652. The relief plug 653 includes an end extended beyond the stepped through-hole 652. The relief plug 653 further has an O-ring 655 mounted to the other end thereof for sealing the stepped through-hole 652 under the action of the spring 654 on the relief plug 653.

Figure 14:
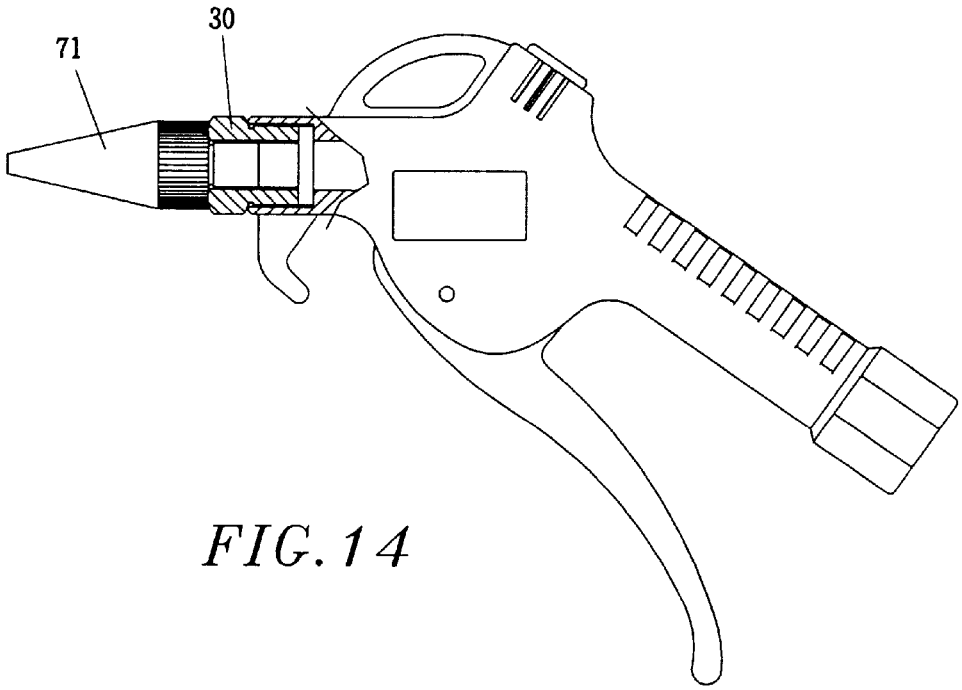
FIG. 14 is a partially sectioned side view illustrating coupling of a dust-abating gun and a main coupler in accordance with the present invention.
Figure 15:
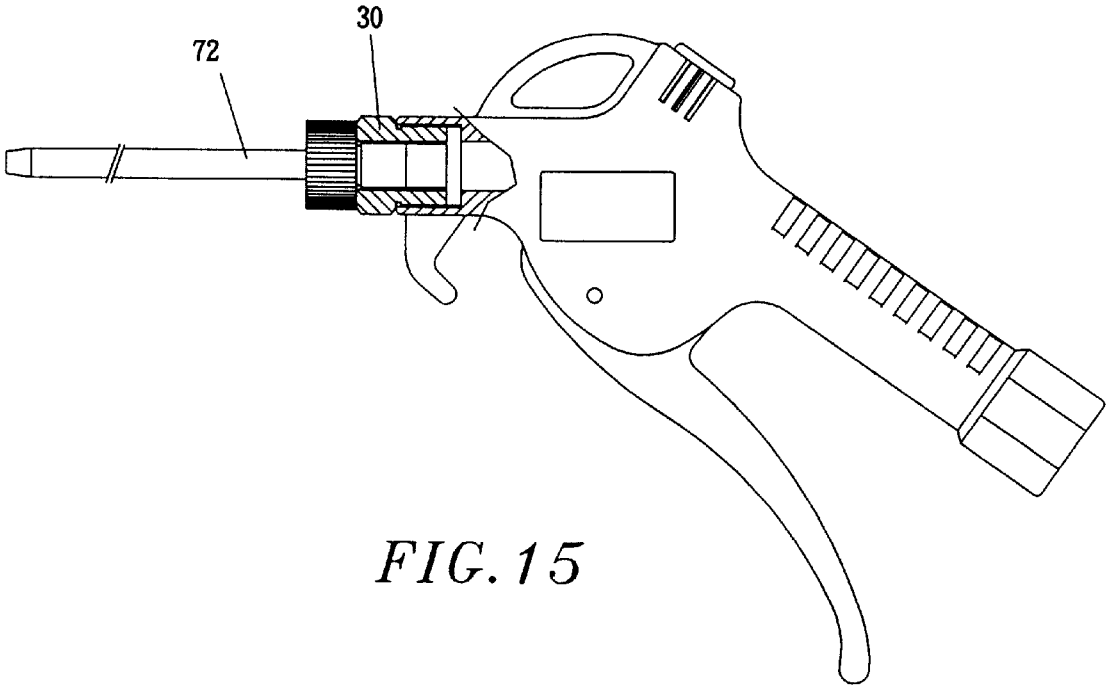
FIG. 15 is a partially sectioned side view illustrating coupling of another kind of dust-abating gun and a main coupler in accordance with the present invention.
Figure 16:
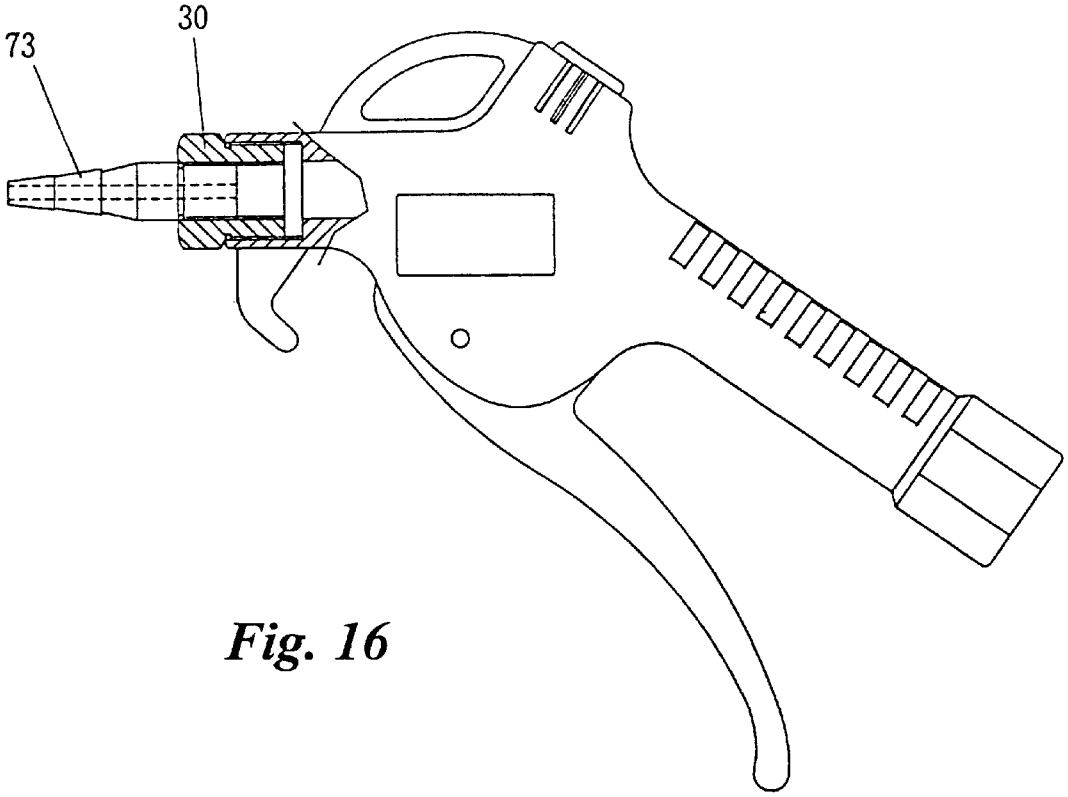
FIG. 16 is a partially sectioned side view illustrating coupling of a life ring inflation fitting and a main coupler in accordance with the present invention.
Figure 17:
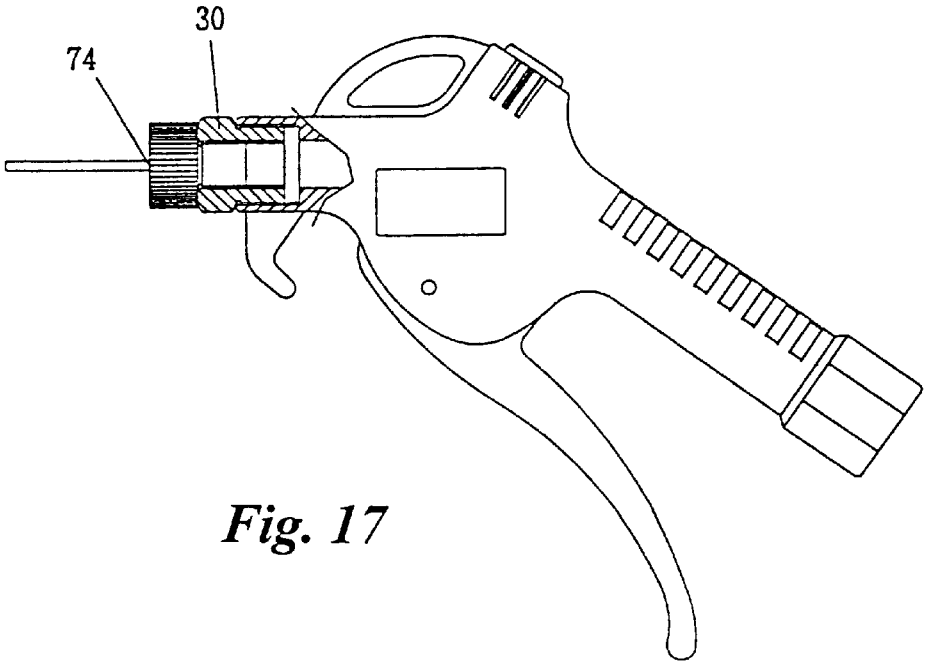
FIG. 17 is a partially sectioned side view illustrating coupling of a ball inflation needle and a main coupler in accordance with the present invention.

1. Application of the Main Coupler in Dust Abatement, Inflation of Rubber Life Ring, and Inflation of Balls:

Referring to FIG. 14, a dust-abating fitting 71 of a shorter length may be directly coupled to the main coupler 30 to form a short dust-abating gun. The assembly can be achieved very quickly and conveniently. Alternatively, a dust-abating fitting 72 of a longer length may be directly coupled to the main coupler 30 to form a long dust-abating gun, as shown in FIG. 15. Referring to FIG. 16, the main coupler 30 may be coupled with an inflation fitting 73 for inflating rubber life rings, inflatable beds, inflatable furniture (e.g., inflatable sofas). Referring to FIG. 17, the main coupler 30 may be coupled with a needle 74 for inflating all kinds of balls. Thus, the main coupler 30 in accordance with the present invention allows easy and convenient coupling for the above-mentioned dust-abating tools and inflation tools that are frequently used in every family.

Figure 6:
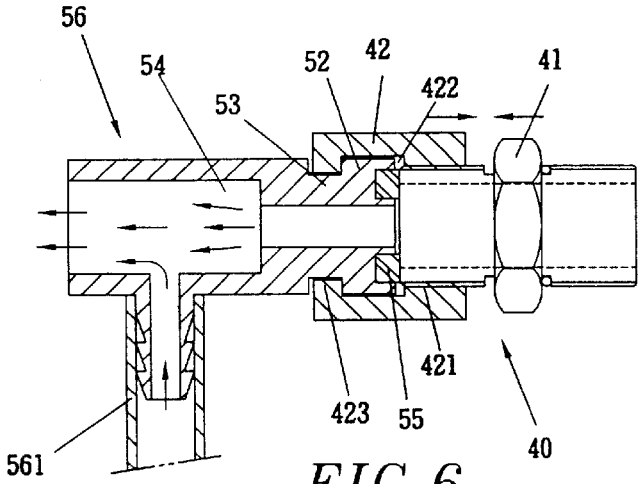
FIG. 6 is a schematic side view, partially sectioned, of a quick coupler and a sprayer fitting in a coupled status.
Figure 7:
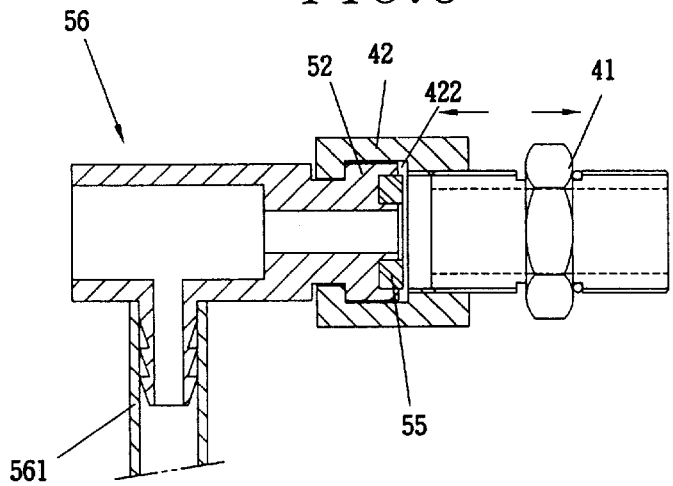
FIG. 7 is a view similar to FIG. 6, illustrating disengagement of the sprayer fitting from the quick coupler.

2. Application of the Quick Coupler:

(1) Sprayer Fitting:

FIG. 6 illustrates an embodiment of a combination of the quick coupler 40 and a sprayer fitting 56. As can be seen from FIG. 6, the end 52 of the sprayer fitting 56 is received in the U-shaped groove 422 of the main body 42. An end face of the fitting 41 bears against the rubber seal ring 55 in the end face of the end 52 of the sprayer fitting 56 to rapidly and completely seal the quick coupler 40. Thus, a quick-to-assemble structure is provided. As can be seen from FIG. 6, the stream of the compressed air from the quick coupler 40 causes a suction force to introduce water from a water source (not shown) via a suction pipe 561 to thereby spray water. FIG. 7 illustrates easy detachment of the fitting 41.

Figure 8:
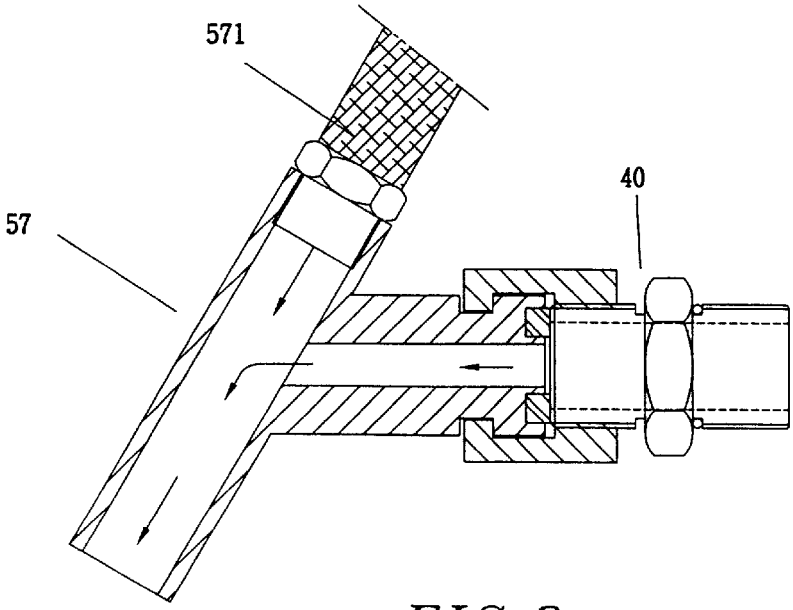
FIG. 8 is a schematic side view, partially sectioned, of a quick coupler and a dust-suction fitting.

(2) Dust-Suction Fitting:

Referring to FIG. 8, the quick coupler 40 may be coupled with a dust-suction fitting 57 that is connected with a suction tube 571. The dust-suction fitting 57 may be quickly engaged with or disengaged from the quick coupler 40. The stream of compressed air from the quick coupler 40 creates a vacuum in the suction tube 571 to thereby performing the function of dust suction.

Figure 9:
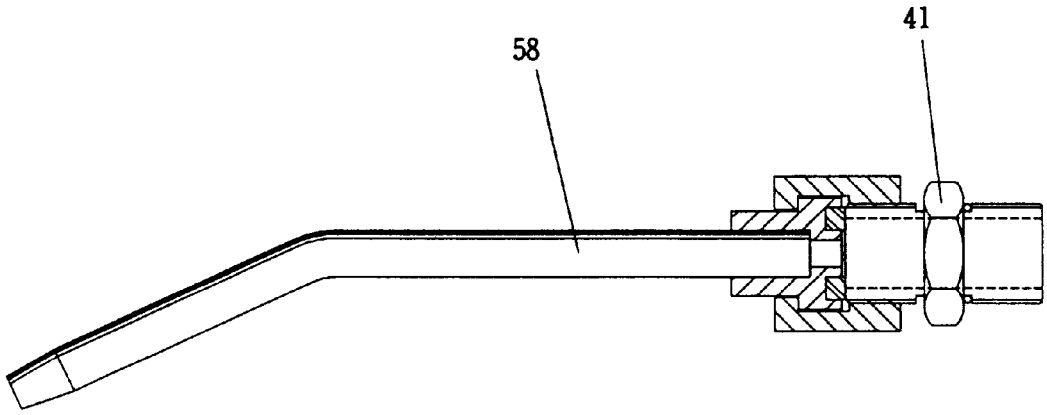
FIG. 9 is a schematic side view, partially sectioned, of a quick coupler and a dust-abating barrel.

(3) Dust-Abating Barrel:

Referring to FIG. 9, the quick coupler 40 may be coupled with a dust-abating barrel 58 that has a slant section in a distal end thereof for controlling the angular position of the barrel 58. More specifically, since the barrel 58 is rotatable through 360°, the barrel 58 can be rotated to a desired angular position and then positioned by the fitting 41. Thus, the barrel 58 can be positioned in a desired angular position in response to the working environment.

The quick coupler 40 allows quick and convenient engagement/disengagement with/from different fittings in the above three embodiments. It is appreciated that all of the fittings can be rotated to a desired angular position before it is positioned to thereby allow adjustment of the suction tube 561, the suction tube 571, or the barrel 58.

Figure 13:
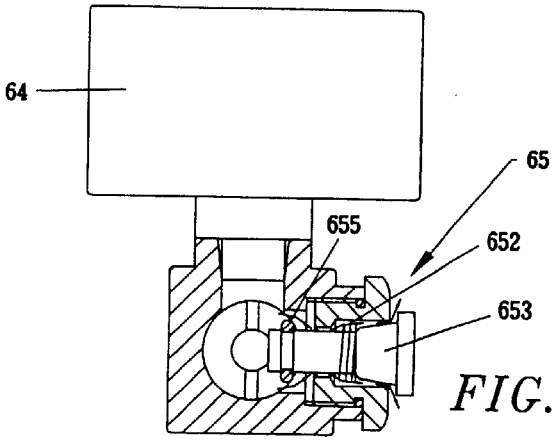
FIG. 13 is a view similar to FIG. 12, illustrating operation of pressure relief.

3. Application of the Inflation Means:

FIG. 11 illustrates an embodiment of an inflation gun 10 comprising the main coupler 30 and the inflation means 60. Compressed air is outputted via an inflation connector 661 attached to an end of the hose 66 for inflating tires. The main body 61 and the inflation fitting 63 are pivotally connected by the pivotal plug 62 such that the main body 61 is rotatable through 360°. Thus, the pressure gauge 64 is rotatable together with the main body 61 to prevent from being damaged when the pressure gauge 64 is impinged. In addition, the pressure gauge 64 can be rotated to any angular position to provide a convenient reading to the user for controlling the inflation. Referring to FIGS. 12 and 13, when the tire is over-inflated, the user may press the relief plug 653 (FIG. 13) to cause the O-ring 655 to disengage from the stepped through-hole 652 (the dust-abating gun 10 is in an inoperative status) such that compressed air in the tire can be released via the stepped through-hole 652 of the relief valve 65 to the environment. The relief plug 653 is released when the air pressure in the tire reaches the desired value upon reading the pressure gauge 64.

According to the above description, it is appreciated that the main coupler 30 in accordance with the present invention can be quickly coupled with all kinds of tools for performing the functions of dust abatement, inflation, dust suction, and water spraying, which is convenient to industry use and family use, and the operation is simple and can be accomplished quickly.

Although the invention has been explained in relation to its preferred embodiment, it is to be understood that many other possible modifications and variations can be made without departing from the spirit and scope of the invention as hereinafter claimed.

What is claimed is:

1. A dust-abating gun comprising a main coupler for engaging with one of an inflation means and a quick coupler, the main coupler including a hexagonal head with an inner screw hole for coupling with all kinds of tools and a hollow shank extending from the hexagonal head, the shank including an outer threading so as to be attached to the dust-abating gun by threading engagement, a through-hole being extended through the hexagonal head and the shank through which compressed air from the dust-abating gun is outputted;

the quick coupler including a first main body and a fitting with an outer threading for engaging with the inner screw hole of the main coupler, the fitting including a nut integrally formed around a mediate portion thereof to separate the outer threading into two portions, the first main body including a first end, a second end, and a U-shaped groove defined in a mediate portion thereof and having a side opening, a screw hole being defined in the first end of the main body and communicated with the U-shaped groove, a U-shaped flange being formed in the second end of the first main body to thereby define a U-shaped opening that also communicates with the U-shaped groove, the U-shaped groove being adapted to receive a coupling member of a tool, the coupling member of the tool including a first annular groove in an outer periphery thereof, the coupling member further including an end with an end face having an annular groove for receiving a rubber seal ring to bear against an end face of the fitting of the quick coupler, thereby providing quick positioning and preventing leakage; and the inflation means including a second main body having a longitudinal stepped through-hole for pivotally receiving a pivotal plug, thereby allowing free rotational movement of the second main body, the pivotal plug including a threaded shank, an inflation fitting including a first end threadedly engaged with the threaded shank of the pivotal plug and a second end threadedly engaged with the screw hole of the main coupler and thus attached to the dust-abating gun, the longitudinal stepped through-hole including an end, a hose being threadedly engaged in the end of the longitudinal stepped through-hole, a pressure gauge being attached to the second main body to indicate the air pressure, a relief valve being attached to the second main body of the inflation means, the relief valve including a base with a stepped through-hole for slidably receiving a relief plug, a spring being mounted around the relief plug and including an end attached to a peripheral wall that defines the stepped through-hole of the base, the relief plug including a first end extended beyond the stepped through-hole of the base and a second end, an O-ring being mounted to the second end thereof for sealing the stepped through-hole of the base under the action of the spring on the relief plug.

* * * * *